US005323714A

United States Patent [19]

Cox

[11] Patent Number: 5,323,714

[45] Date of Patent: Jun. 28, 1994

[54] TIRE GASIFICATION UNIT

[76] Inventor: Donald G. Cox, P.O. Box 0123, Evanston, Wyo. 82931

[21] Appl. No.: 972,850

[22] Filed: Nov. 6, 1992

[51] Int. Cl.[5] ..... F23G 5/12

[52] U.S. Cl. ..... 110/229; 110/212; 110/346; 48/197 R

[58] Field of Search ..... 110/229, 346, 211, 212, 110/214; 431/5; 48/111, 209, 197 R

[56] References Cited

U.S. PATENT DOCUMENTS

| | | | |
|---|---|---|---|
| 3,985,494 | 10/1976 | Childree | 431/5 X |
| 4,402,738 | 9/1983 | Akio | 110/212 X |
| 4,718,362 | 1/1988 | Samten et al. | 110/229 X |
| 5,101,739 | 4/1992 | Nance et al. | 110/229 |
| 5,213,051 | 5/1993 | Kaneko | 110/229 |

FOREIGN PATENT DOCUMENTS

| | | | |
|---|---|---|---|
| 0065820 | 5/1980 | Japan | 110/229 |

OTHER PUBLICATIONS

Scrap Tires: A Resource and Technology Evaluation of Tire Pyrolysis and Other Selected Alternate Technologies, EG&G Idaho, Inc., Dodds, Domenico, Evans & Lassahn, 1983, Distribution Category: UC-95e.

EPA Emissions Compliance Tests for Method 5 Particulates, Air Chem Laboratories.

*Primary Examiner*—Edward G. Favors

*Attorney, Agent, or Firm*—M. Reid Russell

[57] ABSTRACT

A method and apparatus for gasifying tires comprises a housing divided into a tire hopper and vaporization chamber into which air and combustible fluid are inserted through intake manifolds to initially combust and thereafter oxidize tires placed in the housing. Oxidation results in volatile gases and solid residue. The latter is removed through a hatch in the vaporization chamber and the former is shunted to a mixing chamber which comprises an outer compartment, a middle compartment, and an inner compartment. The middle compartment receives the volatile gases which are then mixed with air in the outer and inner compartments. The mixture is combusted with the aid of a combustible fluid mixed in and thereafter shunted to a combustion chamber which further mixes the combustible fluid by means of baffles to thoroughly combust the mixture.

20 Claims, 2 Drawing Sheets

TIRE GASIFICATION UNIT

FIELD OF THE INVENTION

The present invention concerns the field of waste disposal, and particularly the proper disposal and incineration of used motor vehicle tires so as to minimize pollutants and residue and maximize energy output.

BACKGROUND OF THE INVENTION

The proper disposal of vehicle tires has long been a problem in recent years with the proliferation of motor vehicles and the subsequent increase in used tires. Even the casual observer can tell tales of seeing huge piles of tires in gas stations, junkyards, and the like. Though used tires have rapidly increased in number, the methods for their disposal have not kept pace with their increasing numbers. What is more, the usual methods of disposal occasion considerable damage to the environment. The need for proper disposal is illustrated by the many states now paying up to one dollar per tire to terminal disposers pursuant to the National Scrap Tire Act.

Open burning of tires is undesirable because of the large amounts of resulting carbon and pollutants released into the air. Methods have been developed whereby tires are incinerated in closed housings and in which resulting pollutants are minimized, but many of these methods require that the tires be shredded beforehand in order to fully combust. Shredding requires a large expenditure of time and energy and therefore minimizes or eliminates the net amount of useful energy which may result from tire incineration.

Though closed tire incineration methods are more desirable than those conducted in the open air, all methods continue to rely on simple combustion of the tires or similar processes. Such methods are inefficient, often necessitating shredding, and leave large amounts of solid waste residue and produce harmful gases such as carbon monoxide.

OBJECTS AND SUMMARY OF THE INVENTION

It is therefore an object of the present invention to overcome the shortcomings of the prior art.

It is a further object of the invention to provide a portable process in which intact tires are efficiently and completely gasified and thus eliminated without the need for antecedent shredding, with a minimum of resulting harmful gases, solid residue, and pollutants.

It is a further object of the invention to provide an apparatus for carrying out the inventive process.

In accordance with a first aspect of the invention, a process of vaporizing tires comprises the steps of: placing an intact tire in a substantially airtight housing; supplying a predetermined amount of combustible fluid, preferably a gas, to the housing to initiate oxidation of the tire; supplying a predetermined amount of oxygen into the housing; igniting the combustible fluid, causing initial combustion of the combustible fluid and subsequent oxidation of the tire; and allowing additional oxygen into the housing at a controlled rate quickly enough to continue oxidation of the tire and slowly enough to prevent further combustion, thereby anaerobically vaporizing the tire and causing volatile gases to be released from the tire.

In accordance with a second aspect of the invention, a method is provided for mixing volatile gases with air in a mixing chamber comprising an elongate outer compartment, an elongate middle compartment disposed substantially wholly within the outer compartment and having an open end feeding into the outer compartment, and an elongate inner compartment disposed substantially wholly within the middle compartment and having an open end feeding into the middle compartment. The method comprises the steps of: supplying air into the inner compartment; supplying volatile gases into the middle compartment; supplying air into the outer compartment; forcing the air in the inner compartment through the open end thereof into the middle compartment, thereby mixing the air in the inner compartment with the volatile gases in the middle compartment; and forcing the mixture of volatile gases and air in the middle compartment through the open end thereof into the outer compartment, thereby mixing the mixture of volatile gases and air in the middle compartment with the air in the outer compartment.

In accordance with a third aspect of the invention, an apparatus for vaporizing tires, resulting in volatile gases and solid residue, comprises: a vaporization chamber; an air intake leading into the vaporization chamber; a combustible fluid intake leading into the vaporization chamber; and a volatile gases withdrawal manifold leading out of the vaporization chamber.

In accordance with a fourth aspect of the invention, an apparatus for vaporizing and gasifying tires comprises: a vaporization chamber for vaporizing tires resulting in volatile gases; a mixing chamber disposed in series with the vaporization chamber for receiving and mixing of the volatile gases; an outer compartment disposed in the mixing chamber adapted for mixing of the volatile gases with air; a middle compartment disposed substantially within the outer compartment and adapted for reception of the volatile gases from the vaporization chamber; an inner compartment disposed substantially within the middle compartment and adapted to force air into mixture with the volatile gases contained in the middle compartment; a combustion chamber disposed in series with the mixing chamber and adapted to receive the air/volatile gases mixture; and baffles disposed within the combustion chamber adapted to further mix the mixture and thoroughly combust it.

BRIEF DESCRIPTION OF THE DRAWINGS

These and other objects, aspects, and embodiments of the present invention will be described with reference to the attached drawing figures, of which.

DETAILED DESCRIPTION OF THE INVENTION

Figure 1:
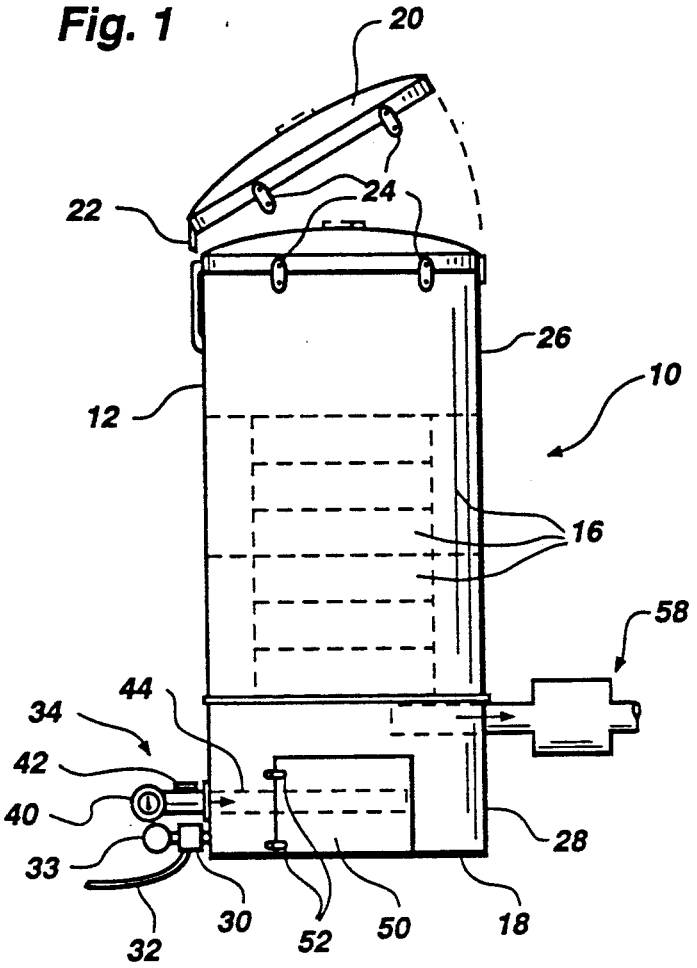
FIG. 1 is a front elevational view in partial cross-section of an example of a tire gasification unit according to the invention.
Figure 2:
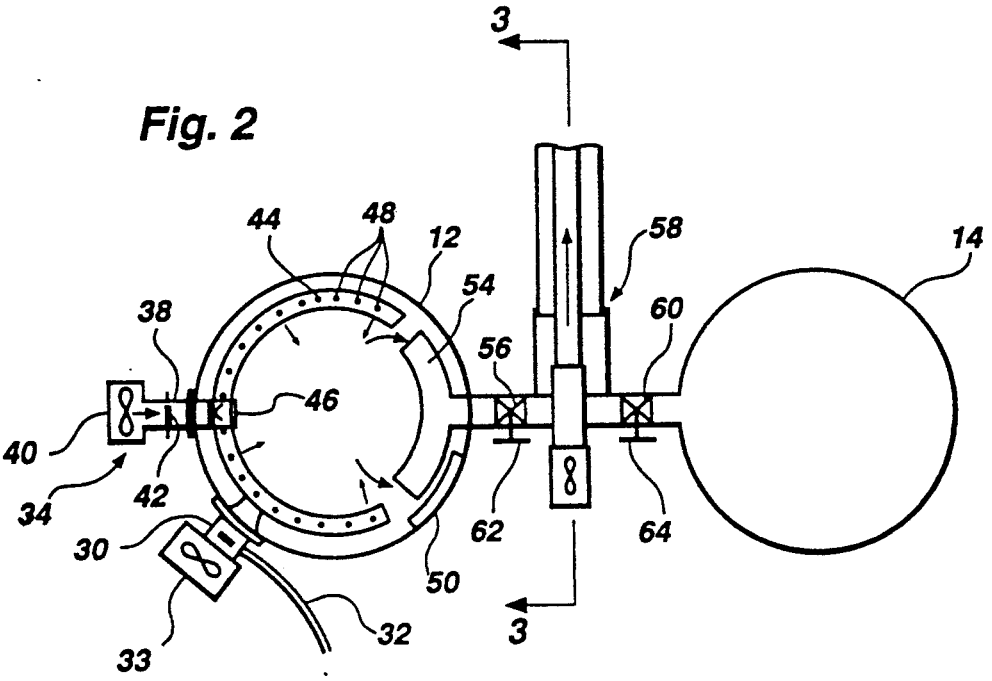
FIG. 2 is a top view in partial cross-section of the tire gasification unit of FIG. 1.

Referring first to FIGS. 1 and 2, an example of a tire gasification unit 10 according to the invention is shown which comprises a pair of closed cylindrical housings 12 and 14, (both shown only in FIG. 2) each of which are five feet high and four feet in diameter in a preferred embodiment, at which size each housing 12 and 14 is adapted to hold 20 to 25 standard automobile tires 16, weighing a total of approximately 500 pounds, which are unshredded and may be randomly packed or packed with some order. Each housing 12 and 14 is constructed of steel or other material which maintains its integrity under high temperatures and is substantially identical to the other. We will confine ourselves to a description of the housing 12, it being understood that the housing 14 comprises similar elements. Two housings are used in the preferred embodiment to enable continuous operation of the unit 10 by operating one while the other is cooled and cleaned. In the preferred embodiment, the housings 12 and 14 each output to the same combustion chamber and other components of the gasification unit 10 which will be described below.

The housing 12 has a closed bottom 18 and a top lid 20 in the preferred embodiment for loading of tires therein. A hinge 22 pivotably mounts the lid 20 to the top of the housing 12 to enable the lid to swing from open to closed positions. Mating clamp members 24 are disposed on the periphery of the lid 20 and the top of the housing 12 to secure the lid 20 to the housing 12 in the closed position. In the preferred embodiment, the housing 12 is substantially airtight during operation in the closed position. The clamp members 24 are preferably spring loaded so that they allow the lid 20 to open at undesirably high pressure levels in the housing 12 to avoid explosion.

Although the housing 12 defines a single cylindrical chamber, it is useful to view the housing 12 as separated into two portions: a tire hopper 26 comprising approximately the upper three fifths of the housing 16, and a vaporization chamber 28, comprising approximately the lower two fifths of the housing 12.

A gas-fired ignition valve 30 is disposed on the wall of the vaporization chamber 28. A tube 32 leads from the valve to a combustible fluid source and also provides electrical connections. A fan blower 33 is mounted on the valve 30 to force air through the valve into the vaporization chamber 28. The valve 30 supplies combustible fluid such as liquid propane or propane gas, along with air, into the vaporization chamber 28 during operation and ignites the fluid with an electric spark at the appropriate time. The ignition valve 30 is of conventional construction and is commercially available.

In a preferred embodiment, approximately two gallons of propane gas are used to start the vaporization process, after which the temperature in the vaporization chamber 28 is high enough to continue the vaporization without further need for fuel.

An air intake assembly 34 is disposed through the wall of the vaporization chamber 28 at an elevation above the ignition valve 30. The assembly 34 comprises an outside housing 38 attached to and running through the outside wall of the vaporization chamber 28. A fan blower 40 and a control valve 42 are disposed in the intake housing 38. The control valve 42 is the passage through which ambient air enters the intake assembly 34, and the blower 40 forces the air into the vaporization chamber 28. An air feed ring manifold 44 (FIG. 2) is disposed within the vaporization chamber 28 and is communicatively attached to the intake housing 38 for reception of the air forced through the housing by the blower 40. The ring manifold 44 contains a directional valve 46 at the point of attachment to the intake housing 38, which directs the air into the ring manifold 44 as desired. The ring manifold itself extends horizontally and circularly around approximately three quarters of the periphery of the vaporization chamber 28 and contains holes 48 through which the air coming from the intake housing 38 enters the vaporization chamber 28. The holes 48 may be spaced according to the rate and uniformity of vaporization desired.

A cleanout hatch 50, approximately two feet wide and one foot high in the preferred embodiment, is disposed in the wall of the vaporization chamber 28. The air intake ring manifold 44 is designed to extend along the entire wall of the vaporization chamber 28 except for the portion of the wall comprising the cleanout hatch 50 in order not to block it. After operation of the vaporization chamber 28 and after the chamber cools, the hatch 50 is opened for removal of tire residue and for cleaning of the vaporization chamber. As mentioned above, during cooling and cleaning of the housing 12, the housing 14 continues to operate in order to keep the gasification unit 10 running continuously, if desired. The hatch 50 contains hinges 52 which enable it to swing from closed to open positions. The hatch is clamped or secured to the vaporization chamber 28 in any suitable manner to make the housing 12 substantially airtight, and, like the clamp members 24 holding the lid 20 on the housing 12, are preferably spring releasable at a certain pressure for safety reasons.

A vapor exhaust manifold 54 (FIG. 2) extends around the interior periphery of the vaporization chamber 28 in similar fashion to the air intake manifold 44, except that the vapor exhaust manifold 54 extends around only about a third of the wall of the vaporization chamber 28. In the preferred embodiment, the vapor exhaust manifold 54 comprises a semi-circular manifold rectangular in cross-section, approximately four inches wide and six inches high in the preferred embodiment, with open ends for reception of vaporized volatiles released from the tires 16. The exhaust manifold 54 is located above the intake manifold 44 in order to receive vapors resulting from vaporization of tires in the upper portion of the vaporization chamber 28.

A vapor exhaust housing 56 communicatively attaches to the manifold 54 and extends through the wall of the vaporization chamber 28 to a mixing chamber 58 which receives the volatiles from the vapor exhaust housing 56. As the housing 14 contains the same components as the housing 12, it also contains a vapor exhaust housing 60 which enters the mixing chamber 58 oppositely from the vapor exhaust housing 56 coming from the housing 12. Valves 62 and 64 are provided in the vapor exhaust housings 56 and 60, respectively, to block them off when their corresponding housings 12 or 14 are not in use in order to maintain the substantially airtight pressure desirable for operation of the housing which is in use, and to keep vapor from entering an inactive housing during cooling and cleaning.

Figure 3:
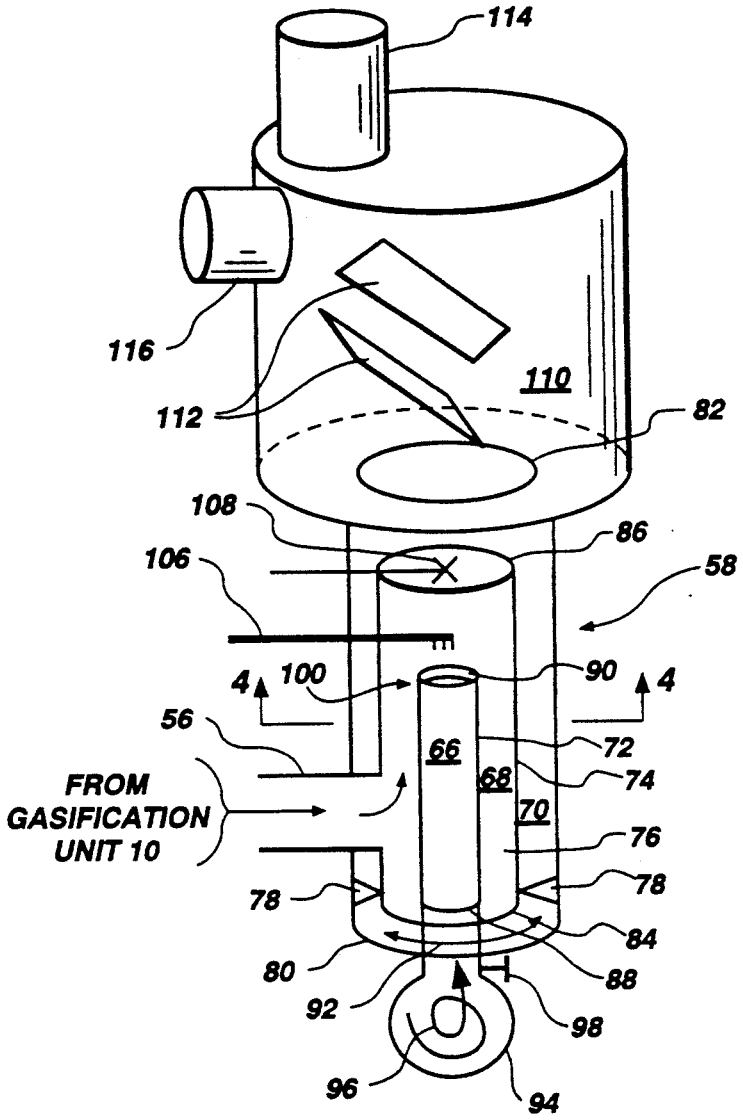
FIG. 3 is a side view in cross-section taken along lines 3—3 of FIG. 2, showing the mixing and combustion chambers.
Figure 4:
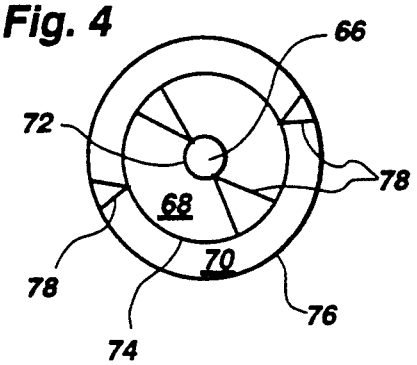
FIG. 4 is a front view in cross-section taken along lines 4—4 of FIG. 3, showing the mixing chamber.
Figure 5:
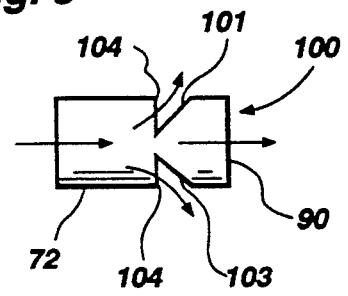
FIG. 5 is a side, elevational view of the inner tube end 90 of FIG. 3.

Referring now additionally to FIGS. 3 to 5, the mixing chamber 58 comprises three separate chambers or compartments: an inner chamber 66, a middle chamber 68, and an outer chamber 70. The chambers are created by cylindrical tubes, an inner tube 72, a middle tube 74, and an outer tube 76, which are disposed coaxially and concentrically to each other and mounted in position by gussets 78 (FIG. 4). The outer tube 76 constitutes the outer housing of the mixing chamber 58. Most of a forward end 80 of the outer tube 76 is closed while its rearward end 82 opens to a combustion chamber 110

(FIG. 3). The middle tube 74 is coaxially mounted within the outer tube 76. A forward end 84 of the middle tube 74 is spaced somewhat rearwardly of the forward end 80 of the outer tube 76, and the middle tube is shorter than the outer tube such that a rearward end 86 of the middle tube is forward of the rearward end 82 of the outer tube, causing the middle tube 74 to be wholly contained within the outer tube 76. Most of the forward end 84 of the middle tube is closed while the rearward end 86 is open. The inner tube 72 is coaxially mounted within the middle tube 74, and an open forward end 88 is flush with the forward end 84 of the middle tube. An open rearward end 90 of the inner tube 72 is disposed forwardly of the rearward end 86 of the middle tube 74. The tubes 72, 74, 76 are oriented in this manner in order to provide optimum mixing of the vaporized volatiles from the vaporization chamber with ambient air for efficient combustion. As will be apparent, the middle tube 74 is both of a smaller diameter and shorter in length than the outer tube 76, and the inner tube 72 is of a smaller diameter and shorter in length than the middle tube 74. In the preferred embodiment, the outer tube 76 has a radius of 8 inches and a length of 39 inches. The middle tube 74 has a radius of 6 inches and a length of 36 inches. The inner tube 72 has a radius of 2 inches and a length of 29 inches. The tubes are constructed of steel or other suitable heat resistant material.

The vapor exhaust housing 56, from the housing 12, extends through the outer tube 76, outer chamber 70, and middle tube 74 into the middle chamber 68. Although not shown, the vapor exhaust housing 60, from the housing 14, does the same from the opposite side of the mixing chamber 58.

The forward end 80 of the outer tube 76 contains an opening 92, forwardly of and coaxial with the open forward end 88 of the inner tube 72, which opens to a blower housing 94 containing a blower 96. A control valve 98 opens into the blower housing 94 to supply ambient air thereto for blowing into the mixing chamber 58. The air forced by the blower through the opening 92 is supplied both to the outer chamber 70 and inner chamber 66 because of the open forward end 88 of the inner tube 72. Since the volatiles from the vapor exhaust 56 are supplied into the middle chamber 68, the mixing chamber 58 mixes these volatiles with air both from the inner chamber 66 and from the outer chamber 70, for thorough mixing.

The rearward end 90 of the inner tube 72 is equipped with a nozzle 100 (FIG. 5) which furthers the mixing of the air and volatiles. The nozzle 100 preferably is created by making partial arc cuts on opposing sides of the inner tube 72 near the rearward end 90, and bending the portions 101 and 103 of the inner tube above the cuts inwardly, creating additional side openings 104. These, in conjunction with the open rearward end 90, cause the ambient air exiting the inner chamber 66 to be turbulent, contributing to the thorough mix of the air with the volatiles in the middle chamber 68.

A propane intake pipe 106 enters the middle chamber 68 through the outer and middle tubes 74 and 76 and slightly rearward of the rearward end 90 of the inner tube 72. The propane intake pipe 106 supplies propane gas or other combustible to the middle chamber 68 to assist in the ignition and combusting of the volatile/air mixture resulting from the air from the inner chamber 66 mixing with the volatiles in the middle chamber 68. Generally, propane need only be supplied into the combusting mixture until its temperature is high enough to sustain combustion alone.

A conventional igniter 108, electrical or other equivalent, is provided at the open rearward end 86 of the middle tube to ignite the volatile/air/propane mixture to commence its combustion as the mixture is forced out of the end 86 of the middle tube. At approximately the same time as the mixture is ignited, the mixture is further mixed with air from the outer chamber 70 to enhance complete and thorough combustion.

A combustion chamber 110 is disposed rearwardly of the mixing chamber 58 and receives the ignited volatile/air/propane mixture from the open rearward end 82 of the outer tube. The combustion chamber 110 is cylindrical and contains flat baffles 112 which extend between opposite sidewalls of the chamber 110, for thorough mixing of the volatiles with the air for complete combustion. The baffles 112 are tilted at opposing slopes at an angle of about 90 degrees, extending across the width of the combustion chamber 110, and cause a turbulent or tumbling effect in the mixture as it enters the chamber. An outlet pipe 114 extends from the rearward end of the combustion chamber 110 and carries away the heat generated by the combustion of the mixture for use in whatever application is desired. The combustion chamber 110 therefore provides additional mixing of the mixture components and completes the combustion which was started by the igniter 108. A pressure vent 116 is provided in the combustion chamber 110 to release pressure at unsafe levels.

In operation of the apparatus 10 (FIGS. 1 and 2), twenty to twenty-five tires 16, weighing a total of about 500 pounds, are loaded into the tire hopper 26 and vaporization chamber 28, defined by the housing 12, through the top end of the housing. The tires 16 are packed into the housing 12 and are in a whole, unshredded, state. The lid 20 of the housing is then closed and the clamp members 24 are secured to create a substantially airtight seal. Propane gas, supplied through the supply tube 32, is then introduced, along with air, into the vaporization chamber 2 through the ignition valve 30. Air may also be introduced into the vaporization chamber 28 through the air intake assembly 34. The propane and air are directed toward the center and bottom of the vaporization chamber 28 and are then ignited by the ignition valve 30. Controlled oxidation of the tires begins and moves across the bottom of the vaporization chamber 28 as it overtakes more tires.

Ideally, the ignition valve 30 would be operated to deliver propane into the vaporization chamber 28 after ignition since the propane is placed into the chamber simply to initiate oxidation of the tires. As a practical matter, it may be necessary to deliver more propane into the vaporization chamber after ignition in order properly to initiate the process. Preferably, once ignition occurs the bottom layer of tires in the vaporization chamber 28 begins to oxidize and the oxidation continues without need for further combustible fuel at relatively low heat levels. It has been found that two gallons of propane gas are satisfactory for ignition and commencement of oxidation. After ignition, air continues to be introduced at a controlled rate into the vaporization chamber through the ring manifold 44 to continue the oxidation, but it is carefully metered through manual adjustment of the control valve 42. Other adjustment means could be substituted, such as computer-controlled adjustment. Temperature measurements could be made on a continual basis using conventional temperature measuring devices disposed, for example, in the walls of the housings 12 and 14.

The controlling of the oxidation rate of the tires is important to the process. If too much air is allowed into the vaporization chamber the tires will burst into flame instead of steadily oxidizing. If too little is allowed in the oxidation will slow unnecessarily. It follows that the container 12 must be substantially airtight in order for the air allowed in to be metered precisely.

The approximate startup time for the process in the preferred embodiment of the apparatus is 45 minutes. With 20 to 25 tires in the housing 12 the process will continue for approximately 8 to 12 hours.

The oxidation of the bottom layer of tires results in heat. When the temperature reaches a level of approximately 300 degrees Fahrenheit, or on the order of between 250 and 350 degrees Fahrenheit, the tires above the bottom layer anaerobically begin to vaporize or gasify, releasing volatile vapors, caused by the heat and the deprivation of oxygen from the upper portion of the vaporization chamber 28, which is filled at this point with carbon dioxide and carbon monoxide. The heat level generated by the oxidation is high enough to stimulate vaporization, but low enough to prevent combustion, i.e., open burning, of the tires. The volatile vapors released from the tires are principally complex hydrocarbons such as ethylene and butylene.

Solid particulate matter left behind in the vaporization chamber 28 after all of the tires are oxidized and/or vaporized comprises approximately five percent of the petrochemical content of the tires as well as steel wire used in tire construction. Although residual carbon ash bound material can also be incinerated, if desired, it is not energy efficient. If continuous operation is desired, after the tires in the housing 12 have been consumed the gasification process is continued in the housing 14 while the housing 12 cools, the residue in the vaporization chamber 12 is removed and the chamber cleaned, and the housing 12 again filled with tires.

The volatile gases or vapors leave the vaporization chamber 28 through the open end of the vapor exhaust manifold 54 and are released into the middle chamber 68 of the mixing chamber 58 (FIG. 3) where they are mixed with air for thorough combustion. The air from the blower 96 and control valve 98 is forced into the forward end 88 of the inner tube 72 and through the inner chamber 66 to the rearward end 90 of the inner tube, where it mixes with the volatile gases in the middle chamber 68, the mixing being enhanced by the turbulence caused by the nozzle 100. The air/vapor mixture from the inner and middle chambers 66 and 68 then moves farther toward the rearward end 86 of the middle tube and is mixed with propane introduced into the middle chamber by the propane intake pipe 106. The air/vapor/propane mixture then reaches the rearward end 86 of the middle tube and is ignited by the igniter 108, combusting into the combustion chamber 110 and mixing with the air from the outer chamber 70. The combusting mixture is then tumbled in the combustion chamber 110 by the baffles 112 for efficient burning. Little to no carbon residue remains after the burning of the volatile gas mixture. The heated air from the combustion is then output from the combustion chamber 110 through the outlet pipe 114. The air output from the combustion chamber 110 is approximately 1600 degrees Fahrenheit, or on the order of between 1100 and 2200 degrees Fahrenheit. Approximately 500 pounds of tires will produce over four million BTU's using the process described.

The stack emissions of the process are within the air quality limits set by the U.S. Department of Air Quality (DEQ) with about 4% carbon dioxide, 14% oxygen, and non-detectable carbon monoxide. TPE, SO2, NOX, and VOC are also well within DEQ and Environmental Protection Agency clean air standards.

The propane supplied through the propane intake pipe 106 is supplied only to start the ignition of the volatile vapor/air mixture. Once the temperature is hot enough, e.g., 500 degrees Fahrenheit in a preferred embodiment, the propane is shut off since the mixture is able now to ignite on its own.

The inventive apparatus and process described herein results in no detectable carbon monoxide or other harmful burn byproduct. Little particulate matter results from the process, consisting mainly of non-carbon based matter from the tires such as steel belts or mesh and some slight carbon residue from the burning of the volatile gases. There is much greater burn efficiency, since much more heat is output from the gasification process than with open air burning of tires. The process is clean, highly efficient, and disposes of whole tires without the need for antecedent shredding. In the preferred embodiment described, the apparatus is portable for maximum efficiency and convenience.

These tires will vaporize in an 8 to 12 hour cycle in a preferred embodiment, producing over four million BTU's. Vaporization time depends on CFM delivered and the heat tolerance of the materials of which the apparatus 10 is constructed.

It can be seen that used vehicle tires, normally considered wasteful and hard to dispose of properly, are disposed of by the present invention with a minimum of residue and with a great amount of energy which may be used for powering other apparatuses. It has been found that the carbon residue left by the tires can also be incinerated, but that the energy necessary for this operation is not worth it. It can be carried out, however, if desired.

I claim:

1. A process of vaporizing tires comprising the steps of:

placing whole tires in a substantially airtight housing;

supplying a pre-determined amount of combustible fluid into the housing to initiate oxidation of the tires;

supplying a pre-determined amount of oxygen into the housing to maintain a temperature inside said housing at approximately five hundred (500) degrees Fahrenheit, and greater, during oxidation of said tires;

igniting the combustible fluid, causing initial combustion of the combustible fluid and subsequent oxidation of the tires; and supplying additional oxygen into the housing at a controlled rate sufficient to continue oxidation of the tires and to prevent further combustion, thereby anaerobically vaporizing the tires and causing volatile gases to be released from the tires.

2. The process of claim 1 further comprising the step of supplying additional combustible fluid into the housing after ignition, to maintain oxidation of the tires.

3. The process of claim 1 further comprising the step of withdrawing volatile gases from the housing at a predetermined level in the housing.

4. The process of claim 3 wherein said combustible fluid and oxygen supplying steps comprise supplying combustible fluid and oxygen to the housing at a location below the level at which volatile gases are withdrawn.

5. The process of claim 3 further comprising the step of combusting the volatile gases withdrawn from the housing to generate heat.

6. A method of mixing volatile gases with air in a mixing chamber comprising an elongate outer compartment, an elongate middle compartment disposed substantially wholly within the outer compartment and having an open end feeding into the outer compartment, and an elongate inner compartment disposed substantially wholly within the middle compartment and having a open end feeding into the middle compartment, comprising the steps of:

(a) supplying air into the inner and outer compartments;

(b) supplying volatile gases into the middle compartment;

(c) forcing the air in the inner compartment through the open end thereof into the middle compartment, thereby mixing the air from the inner compartment with the volatile gases in the middle compartment; and (d) forcing the mixture of volatile gases and air in the middle compartment through the open end thereof into the outer compartment, thereby further mixing the mixture of volatile gases and air in the middle compartment with the air in the outer compartment.

7. The method of claim 6 further comprising the steps of supplying a combustible fluid into the middle compartment and mixing it with the mixture of volatile gases and air and igniting the combustible fluid to cause combustion of the volatile fluid.

8. The method of claim 6 further comprising the steps of forcing the mixture of volatile gases and air in the outer compartment to enter a combustion chamber adjacent the mixing chamber and further mixing the mixture by forcing it past one or more baffles in the combustion chamber.

9. The method of claim 6 wherein step (c) comprises forcing air in the inner compartment through the open end thereof, and through openings in the sides of the inner compartment, near the open end.

10. Method of gasifying tires comprising the steps of:

placing tires in a substantially airtight housing;

introducing a pre-determined amount of combustible fluid into the housing to initiate oxidation of the tire;

introducing a pre-determined amount of oxygen into the housing;

igniting the combustible fluid, causing initial combustion of the combustible fluid and subsequent oxidation of the tire;

introducing additional oxygen into the housing at a controlled rate rapidly enough to continue oxidation of the tire and slowly enough to prevent further combustion to maintain a temperature inside said housing at approximately five hundred (500) degrees Fahrenheit, and greater, during oxidation of said tires, thereby anaerobically vaporizing the tire and causing volatile gases to be released from the tire;

moving the volatile gases from the housing into a mixing chamber;

11. The method of claim 9 further comprising the step of mixing the air/volatile gas mixture with a combustible fluid and subsequently igniting the combustible fluid to combust the air/volatile gas mixture to produce heat.

12. Apparatus for vaporizing tires to produce volatile gases and solid residue, comprising:

a substantially air-tight cylindrical vaporization chamber for receiving and holding tires to be vaporized;

an air intake leading into said cylindrical vaporization chamber for supplying air thereinto, said air intake including valve means for selectively controlling the quantity of air supplied into said cylindrical vaporization chamber;

a combustible fluid intake leading into said cylindrical vaporization chamber for supplying combustible fluid to begin oxidation and vaporization of the tires; and a volatile gases withdrawal manifold that is a ring manifold extending around at least a part of the interior periphery of said cylindrical vaporization chamber that is open at its ends disposed in and leading out of the vaporization chamber for withdrawing volatile gases produced by oxidation of the tires.

13. The apparatus of claim 12 further comprising a hatch disposed in the vaporization chamber to allow access to the chamber for removal of solid residue.

14. The apparatus of claim 12 wherein the volatile gases withdrawal manifold is disposed at an elevation in the vaporization chamber higher than the elevations of the air and combustible fluid intakes.

15. The apparatus of claim 12 wherein the vaporization chamber is substantially cylindrical and the air intake comprises a ring manifold extending around at least part of the interior periphery of the vaporization chamber, to direct air toward the center of the chamber.

16. Apparatus for vaporizing and gasifying tires comprising:

a vaporization chamber for vaporizing tires resulting in volatile gases;

a mixing chamber disposed in communication with the vaporization chamber for reception and mixing of the volatile gases, said mixing chamber comprising an outer compartment;

a middle compartment disposed substantially within the outer compartment for reception of the volatile gases from the vaporization chamber and mixing the volatile gases with air;

an inner compartment disposed substantially within the middle compartment to force air into contact with the volatile gases contained in the middle compartment;

wherein the volatile gases and air mixed in the middle compartment are further mixed with air in the outer compartment.

17. The apparatus of claim 16 further comprising a combustion chamber disposed in series with the mixing chamber for reception and combustion of the air/-volatile gases mixture.

18. The apparatus of claim 17 further comprising a plurality of baffles disposed in the combustion chamber to create turbulence in the mixture for more thorough mixing thereof.

19. The apparatus of claim 17 wherein the wherein the baffles are generally planar and are tilted relative to each other.

20. The apparatus of claim 16 wherein the inner compartment is elongate with an open end opening into the middle compartment, said open end further comprising a plurality of openings staggered and displaced from each other for linear and lateral dispensing of air passing through the inner compartment.

* * * * *